US010788795B2

(12) United States Patent
Higgins et al.

(10) Patent No.: US 10,788,795 B2
(45) Date of Patent: Sep. 29, 2020

(54) MICROFLUIDIC ELAPSED TIME INDICATOR

(71) Applicant: UWI Technology Limited, Edinburgh (GB)

(72) Inventors: Peter Higgins, Edinburgh (GB); Sergey Gordeyev, Edinburgh (GB); David McIlvenna, Edinburgh (GB)

(73) Assignee: UWI TECHNOLOGY LIMITED, Edinburgh (GB)

( * ) Notice: Subject to any disclaimer, the term of this patent is extended or adjusted under 35 U.S.C. 154(b) by 222 days.

(21) Appl. No.: 15/776,116

(22) PCT Filed: Nov. 17, 2016

(86) PCT No.: PCT/GB2016/053590
§ 371 (c)(1),
(2) Date: May 15, 2018

(87) PCT Pub. No.: WO2017/085492
PCT Pub. Date: May 26, 2017

(65) Prior Publication Data

US 2018/0321642 A1 Nov. 8, 2018

(30) Foreign Application Priority Data

Nov. 17, 2015 (GB) ..... 1520229.4

(51) Int. Cl.
*G04F 13/06* (2006.01)
*G04F 1/00* (2006.01)

(52) U.S. Cl.
CPC ..... *G04F 13/06* (2013.01); *G04F 1/00* (2013.01)

(58) Field of Classification Search
CPC . G04F 13/06; G04F 13/04; G04F 1/00; G04F 1/02; G04F 1/06; G04F 1/066; G01K 3/04; G01K 11/12
(Continued)

(56) References Cited

U.S. PATENT DOCUMENTS 4,038,873 A * 8/1977 Kimmel ..... G01K 3/04 374/102
4,292,916 A 10/1981 Bradley
(Continued)

FOREIGN PATENT DOCUMENTS

WO 2008/107871 A1 9/2008

OTHER PUBLICATIONS

International Search Report and Written Opinion dated May 10, 2017 for corresponding International Application No. PCT/GB2016/053590.

(Continued)

*Primary Examiner* — Edwin A. Leon
(74) *Attorney, Agent, or Firm* — Tarolli, Sundheim, Covell & Tummino LLP

(57) ABSTRACT

An elapsed time indicator comprises a reservoir of a fluid, a porous sheet element and a fluid port located between the reservoir and the porous sheet element. The porous sheet element defines a predetermined area which is separated from the fluid port by a predetermined lateral distance. The fluid is selectively provided from the reservoir to the porous sheet element through the fluid port whereupon the porous sheet element transmits the fluid laterally through the porous sheet element at a predetermined rate away from the fluid port until the fluid impregnates the predetermined area of the porous sheet element so as to cause the predetermined area of the porous sheet element to become transparent or more transparent after expiry of a predetermined time period.

27 Claims, 9 Drawing Sheets

(58) Field of Classification Search
USPC ..... 368/89
See application file for complete search history.

(56) References Cited

U.S. PATENT DOCUMENTS

| | | | | |
|---|---|---|---|---|
| 6,373,786 | B1 * | 4/2002 | Kagan | B65D 79/02 368/10 |
| 6,741,523 | B1 * | 5/2004 | Bommarito | G01K 3/04 116/220 |
| 6,916,116 | B2 * | 7/2005 | Diekmann | G01K 3/04 116/216 |
| 7,280,441 | B2 * | 10/2007 | MacDonald | A61F 13/42 116/206 |
| 7,643,378 | B2 * | 1/2010 | Genosar | B65D 33/2591 206/459.1 |
| 2012/0291894 | A1 | 11/2012 | Higgins | |

OTHER PUBLICATIONS

GB Search report dated May 13, 2016 for corresponding GB Application 1520229.4.

* cited by examiner (b)

(a)

MICROFLUIDIC ELAPSED TIME INDICATOR

RELATED APPLICATIONS

The present application is a U.S. National Stage application under 35 USC 371 of PCT Application Serial No. PCT/GB2016/053590, filed on 17 Nov. 2016; which claims priority from GB Patent Application No. 1520229.4, filed 17 Nov. 2015, the entirety of both of which are incorporated herein by reference.

FIELD

A microfluidic elapsed time indicator is described herein for indicating an elapsed time for use, in particular though not exclusively, in a label.

BACKGROUND

Microfluidic elapsed time indicators are known which rely upon the use of microfluidic methods to control the rate of movement or flow of a fluid. Some known microfluidic elapsed time indicators use coloured dyes. Other known microfluidic elapsed time indicators rely upon a chemical reaction with a fluid to produce a visible colour change. It is also known to incorporate such microfluidic elapsed time indicators into labels for attachment to an item or for attachment to a container for an item. Such known microfluidic elapsed time indicators may be unreliable or unsuitable for manufacture. Such known microfluidic elapsed time indicators may not provide a quantitative indication of the elapsed time or may not be sufficiently accurate for some fields of use.

SUMMARY

One or more features of any one of the following aspects may apply alone or in any combination in relation to any of the other aspects. For example, apparatus features may be applied as method features and vice versa.

According to an aspect or an embodiment of the present invention there is provided an elapsed time indicator, comprising:

a reservoir of a fluid;

a porous sheet element; and a fluid port located between the reservoir and the porous sheet element, wherein the porous sheet element defines a predetermined area which is separated from the fluid port by a predetermined lateral distance, wherein the fluid is selectively provided from the reservoir to the porous sheet element through the fluid port whereupon the porous sheet element transmits the fluid laterally through the porous sheet element at a predetermined rate away from the fluid port until the fluid impregnates the predetermined area of the porous sheet element so as to cause the predetermined area of the porous sheet element to become transparent or more transparent after expiry of a predetermined time period.

The fluid may be selectively provided from the reservoir to the porous sheet element in response to an activation event.

The predetermined time period may be measured from the activation event.

The porous sheet element may have first, second and third dimensions, wherein the first dimension is less, for example, significantly less than the second and third dimensions and wherein the lateral direction may refer to a direction which is generally perpendicular to the first dimension. For example, the porous sheet element may have a thickness, a length and a width, wherein the thickness is significantly less than the length and the width and wherein the lateral direction refers to a direction which is generally perpendicular to the thickness.

The predetermined time period may be associated with an item with which the elapsed time indicator is to be associated or to which the elapsed time indicator is to be attached.

The predetermined time period may comprise a lifetime or a shelf-life of the item or a predetermined proportion of a lifetime or a shelf-life of the item.

The fluid may be colourless or clear.

The fluid may comprise an oil.

The fluid may comprise a silicon oil.

The fluid may comprise a mixture of oils.

The porous sheet element may be opaque or substantially opaque before receipt of the fluid.

In use, such an elapsed time indicator may be attached to a coloured object such as a coloured item or a coloured container for an item such that the coloured object becomes visible or more visible through the porous sheet element when the porous sheet element becomes transparent or more transparent. The coloured object may, for example, be green or red.

The elapsed time indicator may comprise an indicator element which becomes visible or more visible through the porous sheet element when the porous sheet element becomes transparent or more transparent.

Such a microfluidic elapsed time indicators does not rely upon the use of chemical reactions to produce a visible colour change according to the time elapsed from a manual activation event. Such a microfluidic elapsed time indicator is generally reliable and suitable for manufacture. Such a microfluidic elapsed time indicator may be configured to provide a quantitative indication of time elapsed from an activation event and/or of the time remaining until expiry of a predetermined time period measured from the activation event.

The indicator element may be coloured.

The indicator element may be green or red.

The indicator element may be non-porous and/or impervious to the fluid.

The indicator element may have a coloured area.

The coloured area may become visible or more visible through the predetermined area of the porous sheet element when the predetermined area of the porous sheet element becomes transparent or more transparent.

The elapsed time indicator may comprise a base layer or a substrate. The indicator element may be defined on the base layer or the substrate.

The elapsed time indicator may comprise a cover layer defining an opaque area and a transparent window area which is generally aligned with the predetermined area of the porous sheet element so that the predetermined area of the porous sheet element is visible through the transparent window area of the cover layer.

The cover layer may be plain in colour. For example, the cover layer may be white.

The cover layer may have one or more symbols, characters, letters, numbers or graphical representations printed or otherwise defined thereon.

The elapsed time indicator may comprise a microfluidic channel which provides a fluid flow path from the reservoir to the fluid port.

The elapsed time indicator may comprise a plurality of microfluidic channels, each microfluidic channel providing a fluid flow path from the reservoir to the fluid port.

The elapsed time indicator may comprise a fluid management layer which defines the reservoir of the fluid and the or each microfluidic channel. Defining the reservoir and the or each microfluidic channel in a single fluid management layer may simplify manufacturing and, therefore, reduce manufacturing costs.

The fluid port may comprise an inlet fluid port.

The elapsed time indicator may comprise an input microfluidic channel which provides a fluid flow path from the reservoir to the inlet fluid port.

The elapsed time indicator may comprise an outlet fluid port for receiving fluid from the porous sheet element.

The inlet fluid port may be defined at, adjacent or near one end of the porous sheet element and the outlet fluid port may be defined at, adjacent or near the other end of the porous sheet element.

The elapsed time indicator may comprise an output microfluidic channel which provides a fluid flow path from the outlet fluid port.

The fluid management layer may define the reservoir and the input and output microfluidic channels. Defining the reservoir and the input and output microfluidic channels in a single fluid management layer may simplify manufacturing and, therefore, reduce manufacturing costs.

The elapsed time indicator may comprise a body which defines a cavity which defines and/or contains the reservoir of the fluid, the or each microfluidic channel, the or each fluid port and the porous sheet element.

The body may comprise one or more layers.

The reservoir may be defined by a layer of the body.

The reservoir may be defined by more than one layer of the body.

The elapsed time indicator may comprise one or more intermediate layers located between the fluid management layer and the porous sheet element. Each of the one or more intermediate layers may be transparent. Each of the one or more intermediate layers may comprise a plastics or a polymer material such as polyethylene terephthalate (PET). Each of the one or more intermediate layers may comprise an adhesive.

Each of the one or more intermediate layers may define a corresponding first aperture. Each of the first apertures of the one or more intermediate layers may be aligned so as to collectively define the inlet fluid port. Each of the one or more intermediate layers may define a corresponding second aperture. Each of the second apertures of the one or more intermediate layers may be aligned so as to collectively define the outlet fluid port.

The elapsed time indicator may comprise one or more further intermediate layers located between the porous sheet element and the cover layer. Each of the one or more further intermediate layers may be transparent. Each of the one or more further intermediate layers may comprise a plastics or a polymer material such as polyethylene terephthalate (PET). Each of the one or more further intermediate layers may comprise an adhesive.

The substrate, the fluid management layer, the one or more intermediate layers and the one or more further intermediate layers may be impervious, non-porous and/or impermeable to the fluid.

The reservoir and/or the or each microfluidic channel may be configured to control the rate of transfer of the fluid from the reservoir to the fluid port.

The reservoir and/or the or each microfluidic channel may be configured to allow the transfer of the fluid from the reservoir to the fluid port in a predetermined transfer time period.

The predetermined transfer time period may constitute a relatively small or negligible proportion of the predetermined time period.

When the predetermined transfer time period constitutes a negligible proportion of the predetermined time period, the porous sheet element may become transparent or more transparent on a timescale that is essentially determined by the lateral distance of the predetermined area of the porous sheet element from the fluid port and the predetermined rate at which the porous sheet element transmits the fluid laterally through the porous sheet element away from the fluid port to the predetermined area of the porous sheet element.

The predetermined transfer time period may constitute less than one tenth of the predetermined time period, less than 1/20 of the predetermined time period, less than 1/50 of the predetermined time period, less than 1/100 of the predetermined time period, less than 1/1000 of the predetermined time period or less than 1/10000 of the predetermined time period.

A shape and/or size of the reservoir may be selected to control the rate of transfer of the fluid from the reservoir to the fluid port.

The length and/or cross-sectional dimensions of the or each microfluidic channel may be selected to control the rate of transfer of the fluid from the reservoir to the fluid port.

The reservoir and/or the or each microfluidic channel may be configured to control the predetermined rate at which the fluid is transmitted laterally through the porous sheet element.

A shape and/or size of the reservoir may be selected to control the predetermined rate at which the fluid is transmitted laterally through the porous sheet element.

The length and/or cross-sectional dimensions of the or each microfluidic channel may be selected to control the predetermined rate at which the fluid is transmitted laterally through the porous sheet element.

The or each microfluidic channel may have at least one cross-sectional dimension of 100-200 μm or less.

The or each microfluidic channel may have a width of 2 mm or less and a height of 10-100 μm or less.

The or each microfluidic channel may be straight.

The or each microfluidic channel may define at least one straight section.

The or each microfluidic channel may define at least one bend.

The elapsed time indicator may comprise a deformable membrane which defines the reservoir of the fluid.

The cavity may be initially sealed but may be configured to be selectively exposed to an environment external to the elapsed time indicator.

The body may define an indicator vent extending from the cavity. The indicator vent may extend from the cavity from a position at or adjacent to the porous sheet element. The indicator vent may extend from an outlet of the output microfluidic channel.

The body may define a reservoir vent extending from the cavity. The reservoir vent may extend from the cavity from a position at or adjacent to the reservoir.

The reservoir vent may extend from the cavity from a position at, adjacent or near to one end of the cavity and the indicator vent may extend from the cavity from a position at, adjacent or near to the other end of the cavity.

The activation event may cause at least one of the indicator vent and the reservoir vent to be unsealed.

The indicator vent may be initially sealed but may be configured to be selectively unsealed to provide a fluid flow path from the cavity to the environment external to the elapsed time indicator through the indicator vent.

The reservoir vent may be initially sealed but may be configured to be selectively unsealed to provide a fluid flow path from the cavity to the environment external to the elapsed time indicator through the reservoir vent.

The indicator vent and the reservoir vent may be configured to be selectively unsealed at the same time.

The indicator vent and the reservoir vent may be configured to be selectively unsealed at different times.

The indicator vent and the reservoir vent may be configured to be selectively unsealed in response to the activation event.

One of the indicator vent and the reservoir vent may be configured to be selectively unsealed in response to the activation event.

The elapsed time indicator may comprise a seal member detachably attached to the body so as to initially seal at least one of the indicator vent and the reservoir vent.

The indicator vent may be unsealed by detaching the seal member from the body.

The body of the elapsed time indicator may be attachable to a first part of a container. The seal member may be attachable to a second part of the container such that opening the container for the first time by relative movement of the first and second parts of the container causes the seal member to be detached from the body and at least one of the indicator vent and the reservoir vents to be unsealed.

The elapsed time indicator may comprise a seal member which is detachably attached to the body so as to initially seal one of the indicator vent and the reservoir vent. The indicator vent and the reservoir vent may be connected by an air channel. The air channel may be defined separately from the microfluidic channel such that detaching the seal member from the body unseals both the indicator vent and the reservoir vent.

The air channel may be defined by the body.

One of the indicator vent and the reservoir vent may be permanently open and the other of the indicator vent and the reservoir vent may be configured to be selectively unsealed to provide a fluid flow path from the cavity to the environment external to the elapsed time indicator through the other of the indicator vent and the reservoir vent.

The elapsed time indicator may comprise an indicator vent seal member detachably attached to the body so as to initially seal the indicator vent.

The indicator vent may be unsealed by detaching the indicator vent seal member from the body.

The elapsed time indicator may comprise a reservoir vent seal member detachably attached to the body so as to initially seal the reservoir vent.

The reservoir vent may be unsealed by detaching the reservoir vent seal member from the body.

Air in the cavity on a first side of the fluid in the fluid reservoir may be at a first pressure prior to the activation event. For example, air in the cavity above the fluid in the fluid reservoir may be at the first pressure prior to the activation event. Air in the reservoir vent may be at the first pressure prior to the activation event. Air in the cavity on a second side of the fluid in the fluid reservoir may be at a second pressure prior to the activation event. For example, air in the cavity below the fluid in the fluid reservoir may be at the second pressure prior to the activation event. Air in the input microfluidic channel, the inlet fluid port, around the porous sheet element, in the outlet fluid port and in the outlet microfluidic channel may be at the second pressure prior to the activation event. The first pressure may be less than the second pressure. The first pressure may be less than atmospheric pressure. The second pressure may be greater than atmospheric pressure. The presence of air in the cavity on a first side side of the fluid in the fluid reservoir having a reduced pressure prior to the activation event and the presence of air in the cavity on a second side of the fluid in the fluid reservoir opposite the first side prior to the activation event may serve to retain the fluid in the fluid reservoir prior to the activation event.

The porous sheet element may comprise a plurality of predetermined areas, each predetermined area being separated from the fluid port by a corresponding predetermined lateral distance such that one of the predetermined areas of the porous sheet element becomes transparent or more transparent after expiry of the predetermined time period and each of the other predetermined areas become transparent or more transparent after expiry of a corresponding intermediate predetermined time period.

Each of the intermediate predetermined time periods may be a predetermined proportion of the predetermined time period.

Each of the intermediate predetermined time periods may be measured from the time of the activation event.

Two or more of the coloured areas may have the same colour.

Two or more of the coloured areas may have a different colour.

One or more of the coloured areas may be green.

One or more of the coloured areas may be red.

The cover layer may define an opaque area and one transparent window area for each predetermined area of the porous sheet element. Each transparent window area of the cover layer may be generally aligned with a corresponding one of the predetermined areas of the porous sheet element so that the corresponding predetermined area of the porous sheet element is visible through the corresponding transparent window area of the cover layer.

The predetermined rate of transmission of the fluid in the porous sheet element may depend on at least one property of the fluid.

The predetermined rate of transmission of the fluid in the porous sheet element may depend on the composition and/or viscosity of the fluid.

The predetermined rate of transmission of the fluid in the porous sheet element may depend on at least one property of the porous sheet element.

The predetermined rate of transmission of the fluid in the porous sheet element may depend on the composition and/or porosity of the porous sheet element.

The porous sheet element may comprise fibres.

The porous sheet element may comprise cellulose fibres.

The porous sheet element may comprise paper.

The porous sheet element may comprise filter paper.

The elapsed time indicator may be flexible.

The elapsed time indicator may be configured for use in a predetermined orientation. For example, the elapsed time indicator may be configured for use in a predetermined orientation in which the reservoir is located above the porous sheet element. The elapsed time indicator may comprise markings such as "this way up" arrows or the like so as to indicate a required orientation of the elapsed time indicator. For example, the cover layer may have markings such as "this way up" arrows or the like so as to indicate a required orientation of the elapsed time indicator. Orienting the elapsed time indicator so that the reservoir is located above the porous sheet element may cause the fluid to flow from the reservoir towards the porous sheet element under the action of gravity/hydrostatic pressure in combination with capillary action.

According to an aspect or an embodiment of the present invention there is provided a label comprising an elapsed time indicator which includes:

a reservoir of a fluid;

a porous sheet element; and a fluid port located between the reservoir and the porous sheet element, wherein the porous sheet element defines a predetermined area which is separated from the fluid port by a predetermined lateral distance, wherein the fluid is selectively provided from the reservoir to the porous sheet element through the fluid port whereupon the porous sheet element transmits the fluid laterally through the porous sheet element at a predetermined rate away from the fluid port until the fluid impregnates the predetermined area of the porous sheet element so as to cause the predetermined area of the porous sheet element to become transparent or more transparent after expiry of a predetermined time period.

The fluid may be selectively provided from the reservoir to the porous sheet element in response to an activation event.

The predetermined time period may be measured from a time of the activation event.

According to an aspect or an embodiment of the present invention there is provided a container comprising an elapsed time indicator which includes:

a reservoir of a fluid;

a porous sheet element; and a fluid port located between the reservoir and the porous sheet element, wherein the porous sheet element defines a predetermined area which is separated from the fluid port by a predetermined lateral distance, wherein the fluid is selectively provided from the reservoir to the porous sheet element through the fluid port whereupon the porous sheet element transmits the fluid laterally through the porous sheet element at a predetermined rate away from the fluid port until the fluid impregnates the predetermined area of the porous sheet element so as to cause the predetermined area of the porous sheet element to become transparent or more transparent after expiry of a predetermined time period.

The fluid may be selectively provided from the reservoir to the porous sheet element in response to an activation event.

The predetermined time period may be measured from a time of the activation event.

According to an aspect or an embodiment of the present invention there is provided a method for indicating an elapsed time, comprising:

providing a porous sheet element;

providing a fluid port;

defining a predetermined area of the porous sheet element which is separated from the fluid port by a predetermined lateral distance; and selectively providing a fluid to the porous sheet element through the fluid port whereupon the porous sheet element transmits the fluid laterally through the porous sheet element at a predetermined rate away from the fluid port until the fluid impregnates the predetermined area of the porous sheet element so as to cause the predetermined area of the porous sheet element to become transparent or more transparent after expiry of a predetermined time period.

The fluid may be selectively provided to the porous sheet element from a reservoir of the fluid.

The fluid may be selectively provided from the reservoir to the porous sheet element in response to an activation event.

The predetermined time period may be measured from a time of the activation event.

The method may comprise orienting the reservoir of the fluid above the porous sheet element.

BRIEF DESCRIPTION OF THE DRAWINGS

An elapsed time indicator is described herein by way of non-limiting example only with reference to the following drawings of which:

FIG. 2(*b*) is a schematic cross-section on AA of the microfluidic elapsed time indicator of FIG. 2(*a*) immediately after activation;

FIG. 3(*b*) is a schematic plan view of the microfluidic elapsed time indicator of FIG. 1 after expiry of a first time period after activation;

FIG. 3(*c*) is a schematic plan view of the microfluidic elapsed time indicator of FIG. 1 after expiry of a second time period after activation;

FIG. 3(*d*) is a schematic plan view of the microfluidic elapsed time indicator of FIG. 1 after expiry of a final time period after activation;

FIG. 4(*b*) is a schematic illustration of the microfluidic elapsed time indicator of FIG. 1 immediately after opening the two-part container for the first time so as to activate the elapsed time indicator;

FIG. 5(*b*) is a schematic plan view of a second alternative microfluidic elapsed time indicator before activation;

FIG. 5(*c*) is a schematic plan view of a third alternative microfluidic elapsed time indicator before activation;

FIG. 6(*b*) is a schematic plan view of the fourth alternative microfluidic elapsed time indicator of FIG. 6(*a*) after expiry of a first time period after activation;

FIG. 6(*c*) is a schematic plan view of the fourth alternative microfluidic elapsed time indicator of FIG. 6(*a*) after expiry of a final time period after activation;

FIG. 7(*b*) is a schematic plan view of the fifth alternative microfluidic elapsed time indicator of FIG. 7(*a*) after expiry of a first time period after activation;

FIG. 7(*c*) is a schematic plan view of the fifth alternative microfluidic elapsed time indicator of FIG. 7(*a*) after expiry of a final time period after activation;

FIG. 8(*b*) shows the exploded assembly view of the sixth alternative microfluidic elapsed time indicator of FIG. 8(*a*) illustrating a fluid flow path;

FIG. 9(*b*) is a schematic illustration of the sixth alternative microfluidic elapsed time indicator of FIGS. 8(*a*) and 8(*b*) immediately after opening the two-part container for the first time so as to activate the elapsed time indicator.

DETAILED DESCRIPTION OF THE DRAWINGS

Figure 1:
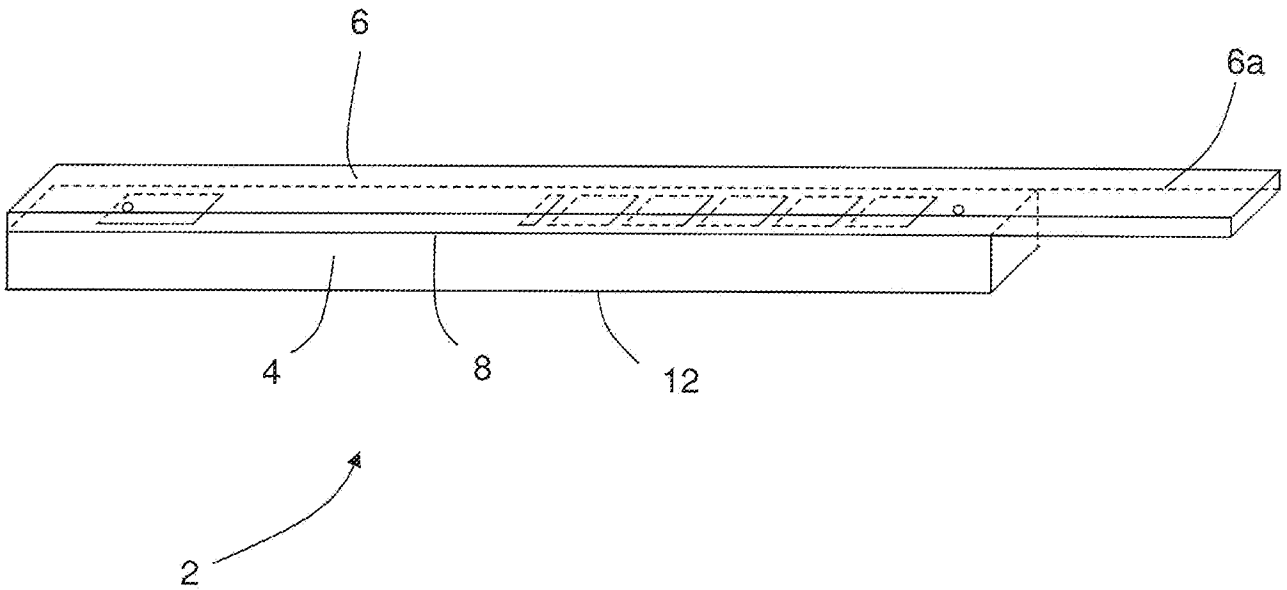
FIG. 1 is a schematic perspective view of a microfluidic elapsed time indicator before activation.

Referring initially to FIG. 1 there is shown a microfluidic elapsed time indicator generally designated 2 including a body 4 and a seal member 6 which is detachably attached to an upper surface 8 of the body 4. The seal member 6 defines a tab portion 6*a* which is distal from the body 4. The body 4 includes an adhesive layer (not shown explicitly in FIG. 1) on its lower surface 12 for attachment of the body 4 to an object (not shown) such as a perishable item or a container for a perishable item. The body 4 is flexible to allow the body 4 to conform to the shape of a variety of different objects. The microfluidic elapsed time indicator 2 may be, or may form part of, a label for attachment to the object. As such, one of ordinary skill in the art will understand that the microfluidic elapsed time indicator 2 is illustrated schematically in FIG. 1 and that the relative proportions of the microfluidic elapsed time indicator 2 may be significantly different to those represented in FIG. 1. In particular, the thickness of the microfluidic elapsed time indicator 2 (i.e. the height or dimension of the microfluidic elapsed time indicator 2 in the vertical direction in FIG. 1) has been exaggerated in the interests of clarity.

In use, the tab portion 6*a* of the seal member 6 may be pulled until the seal member 6 becomes detached from the body 4. As will be described in more detail below, detachment of the seal member 6 from the body 4 results in activation of the microfluidic elapsed time indicator 2 which subsequently provides a visual indication of the amount of time elapsed from activation.

Figure 2:
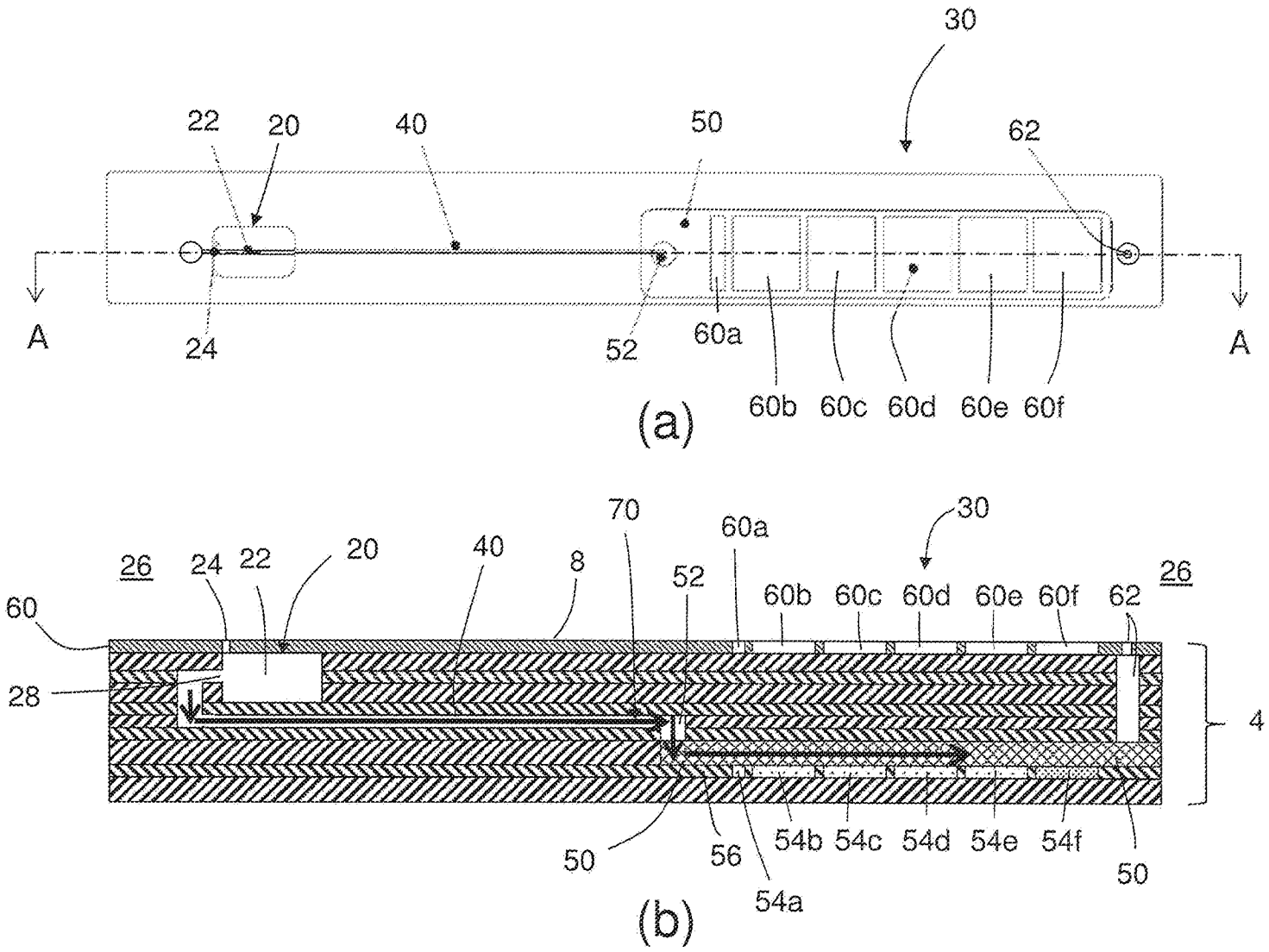
FIG. 2(*a*) is a schematic plan view of the microfluidic elapsed time indicator of FIG. 1 immediately after activation.

The microfluidic elapsed time indicator 2 is shown in more detail in FIGS. 2(*a*) and 2(*b*) immediately after detachment of the seal member 6 from the body 4. The microfluidic elapsed time indicator 2 includes a reservoir 20 of a fluid 22, a display arrangement 30 and a microfluidic channel 40 extending from the reservoir 20 to the display arrangement 30. As shown in FIG. 2(*b*), the body 4 includes several different layers which together define the reservoir 20, the microfluidic channel 40 and the display arrangement 30. Unless otherwise stated below, one of ordinary skill in the art will understand that the various different layers of the body 4 are impervious, non-porous and/or impermeable to the fluid 22.

The body 4 defines an opening in the form of a reservoir vent 24 which extends from the reservoir 20 to the upper surface 8 the body 4. Prior to detachment of the seal member 6 from the body 4, the reservoir vent 24 is sealed by the seal member 6. Detachment of the seal member 6 from the body 4 unseals or opens the reservoir vent 24 so that the reservoir vent 24 provides a flow path for air from the reservoir 20 to an environment generally designated 26 external to the body 4 as shown in FIG. 2(*b*). The body 4 defines a reservoir outlet fluid port 28. The fluid 22 may be a silicon oil having a viscosity in the range of 10 to 5,000 cP.

The display arrangement 30 includes a porous sheet element in the form of a paper element 50 which is configured to be initially opaque or generally opaque and to become transparent or more transparent upon impregnation by the fluid 22. The display arrangement 30 further includes an inlet fluid port 52 in fluid flow communication with the paper element 50. The microfluidic channel 40 provides a fluid flow path from the reservoir outlet fluid port 28 to the inlet fluid port 52 of the display arrangement 30. The display arrangement 30 includes a plurality of coloured indicator areas 54*a*, 54*b*, 54*c*, 54*d*, 54*e* and 54*f* defined on an indicator element or layer 56 located below the paper element 50. Although not shown explicitly in FIG. 2(*a*) and 2(*b*), the indicator areas 54*a*, 54*b*, 54*c*, 54*d*, and 54*e* are green and the indicator area 54*f* is red.

The body 4 includes an upper cover layer 60 which defines a plurality of transparent windows 60*a*, 60*b*, 60*c*, 60*d*, 60*e* and 60*f*, each window 60*a*, 60*b*, 60*c*, 60*d*, 60*e* and 60*f* being aligned generally above a corresponding one of the coloured indicator areas 54*a*, 54*b*, 54*c*, 54*d*, 54*e* and 54*f* respectively. It should also be understood that the intervening layers of the body 4 located between the paper element 50 and upper cover layer 60 are generally transparent.

The body 4 further defines an opening in the form of an indicator vent 62 which extends from the paper element 50 to the upper surface 8 the body 4. Prior to detachment of the seal member 6 from the body 4, the indicator vent 62 is sealed by the seal member 6. Detachment of the seal member 6 from the body 4 unseals or opens the indicator vent 62 so that the indicator vent 62 provides a flow path for air from the paper element 50 to the external environment 26.

It should be understood that the body 4 defines a cavity generally designated 70 which includes the fluid reservoir 20, the reservoir outlet fluid port 28, the microfluidic channel 40, the inlet fluid port 52 of the display arrangement 30 and the paper element 50. Prior to detachment of the seal member 6 from the body 4, the cavity 70 is sealed from the external environment 26.

Detachment of the seal member 6 from the body 4 activates the elapsed time indicator 2 by unsealing the reservoir vent 24 thereby exposing the end of the cavity 70 adjacent to the reservoir 20 to the pressure of the external environment 26 and unsealing the indicator vent 62 thereby exposing the end of the cavity 70 adjacent to the paper element 50 to the pressure of the external environment 26. Following activation by detachment of the seal member 6 from the body 4, capillary action causes the fluid 22 to move along the microfluidic channel 40 from the reservoir outlet fluid port 28 to the inlet fluid port 52 of the display arrangement 30 on a relatively short timescale which may range from several seconds to several minutes. Air flows in through the reservoir vent 24 to replace the fluid 22 lost from the reservoir 20 and air flows out of the indicator vent 62 to allow the fluid 22 to move towards the paper element 50.

On contacting the paper element 50, capillary action causes the fluid 22 to move in a lateral direction through the paper element 50 at a predetermined rate which is dependent primarily upon the composition of the paper element 50 and the viscosity of the fluid 22. As the fluid 22 impregnates the paper element 50, the paper element 50 becomes transparent or becomes more transparent so that the coloured indicator areas 54*a*, 54*b*, 54*c*, 54*d*, 54*e*, 54*f* become visible or become more visible sequentially through the transparent windows 60*a*, 60*b*, 60*c*, 60*d*, 60*e* and 60*f* at predetermined times after activation.

Figure 3:
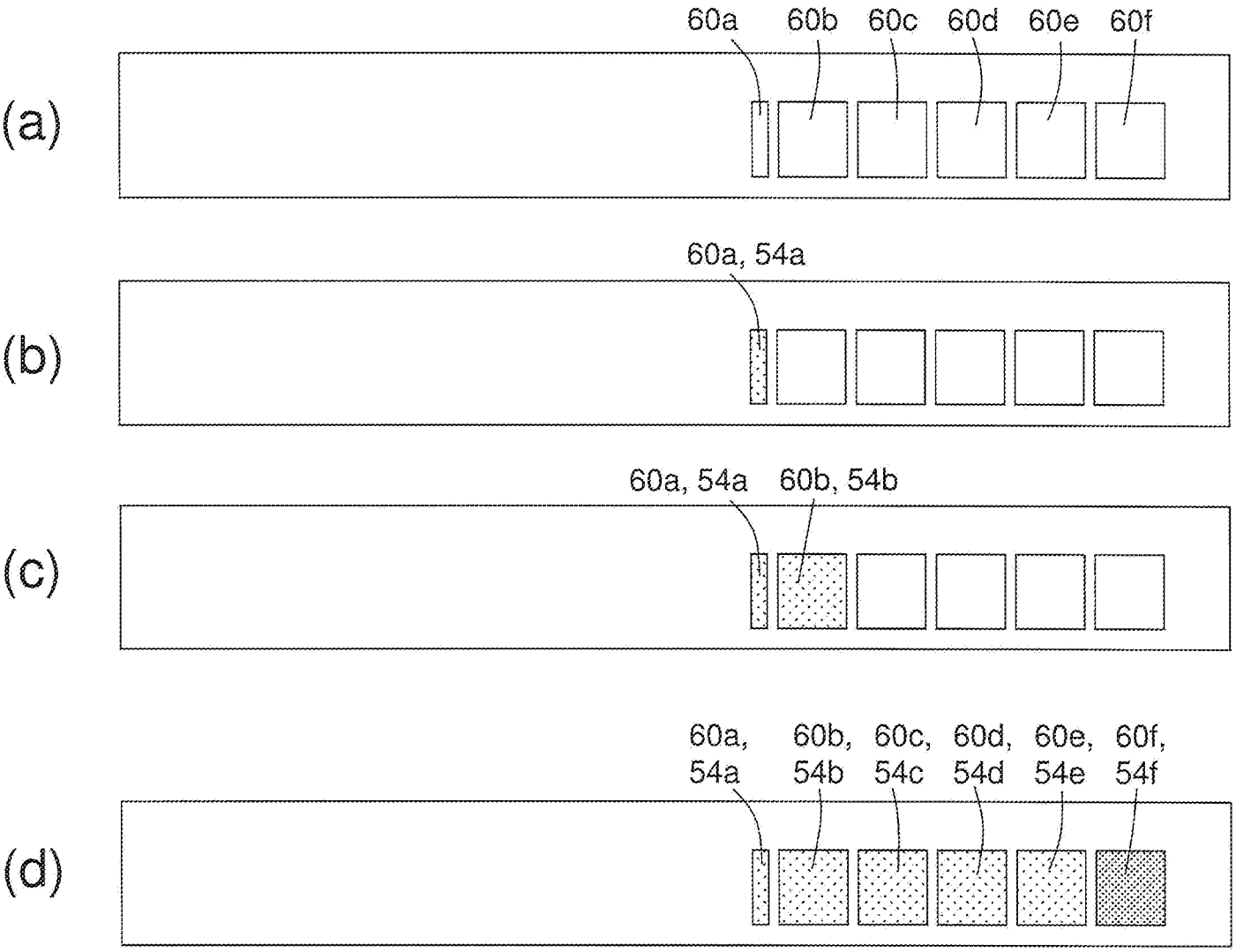
FIG. 3(*a*) is a schematic plan view of the microfluidic elapsed time indicator of FIG. 1 immediately after activation.

As shown in FIGS. 3(*a*)-3(*d*), the appearance of the coloured indicator areas 54*a*, 54*b*, 54*c*, 54*d*, 54*e*, 54*f* provides a visual indication of the time elapsed from activation. In the interests of clarity, FIGS. 3(*a*)-3(*d*) omit many of the details of the elapsed time indicator 2. As shown in FIG. 3(*a*) immediately after activation, none of the coloured indicator areas 54*a*, 54*b*, 54*c*, 54*d*, 54*e*, 54*f* are visible through the windows 60*a*, 60*b*, 60*c*, 60*d*, 60*e* and 60*f*. As shown in FIG. 3(*a*) following expiry of a first intermediate predetermined time period after activation, the first green indicator area 54*a* closest to the inlet fluid port 52 of the display arrangement 30 becomes visible or becomes distinctly more visible through the window 60*a*. Similarly, as shown in FIG. 3(*b*), following expiry of a second intermediate predetermined time period after activation, the second green indicator area 54*b* adjacent to the first green indicator area 54*a* also becomes visible or becomes distinctly more visible through the window 60*b*. As shown in FIG. 3(*d*) following expiry of a final predetermined time period after activation, the red indicator area 54*f* furthest from the inlet fluid port 52 of the display arrangement 30 also becomes visible or becomes distinctly more visible through the window 60*f*. The final predetermined time period may be selected according to a lifetime or a shelf-life of an item to which the elapsed time indicator 2 is to be attached. The intermediate predetermined time periods, including the first intermediate and second intermediate predetermined time periods, may comprise a predetermined proportion of the final predetermined time period. The rate at which the fluid moves laterally though the paper element 50 may be selected by selecting the porosity of the paper element 50 and/or the viscosity of the fluid 22. The lateral positions of the indicator areas 54*a*, 54*b*, 54*c*, 54*d*, 54*e*, 54*f* may also be selected so that when the elapsed time indicator 2 is activated at the beginning of the lifetime or shelf-life of the item concerned, the sequential appearance of the green indicator areas 54*a*, 54*b*, 54*c*, 54*d*, 54*e* provides a progressive indication of the time remaining before expiry of the lifetime or shelf-life of the item, whereas the appearance of the red indicator area 54*f* indicates that the lifetime or shelf-life of the item has actually expired.

It should be understood that the reservoir 20 and the microfluidic channel 40 are configured to control the rate of transfer of the fluid from the reservoir 20 to the inlet fluid port 52. Specifically, the reservoir 20 and the microfluidic channel 40 are configured to allow the transfer of the fluid 22 from the reservoir 20 to the inlet fluid port 52 in a predetermined transfer time period which constitutes a relatively small or negligible proportion of the final predetermined time period such that the timing of the appearance of the indicator areas 54*a*, 54*b*, 54*c*, 54*d*, 54*e*, 54*f* is essentially determined by the lateral positions of the indicator areas 54*a*, 54*b*, 54*c*, 54*d*, 54*e*, 54*f* relative to the fluid port and the predetermined rate at which the paper element 50 transmits the fluid laterally through the paper element 50 away from the inlet fluid port 52. The predetermined transfer time period may, for example, be of the order of minutes and the final predetermined time period may be of the order of several hours or more. The predetermined transfer time period may constitute less than one tenth of the final predetermined time period, less than 1/20 of the final predetermined time period, less than 1/50 of the final predetermined time period, less than 1/100 of the final predetermined time period, less than 1/1000 of the final predetermined time period or less than 1/10000 of the final predetermined time period. Moreover, it should be understood that the configuration of the reservoir 20 and the microfluidic channel 40 also affect the predetermined rate at which the fluid is transmitted laterally through the porous sheet element. Consequently, the shape and/or size of the reservoir 20 and the length and/or cross-sectional dimensions of the microfluidic channel 40 are also selected according to the final predetermined time period.

Figure 4:
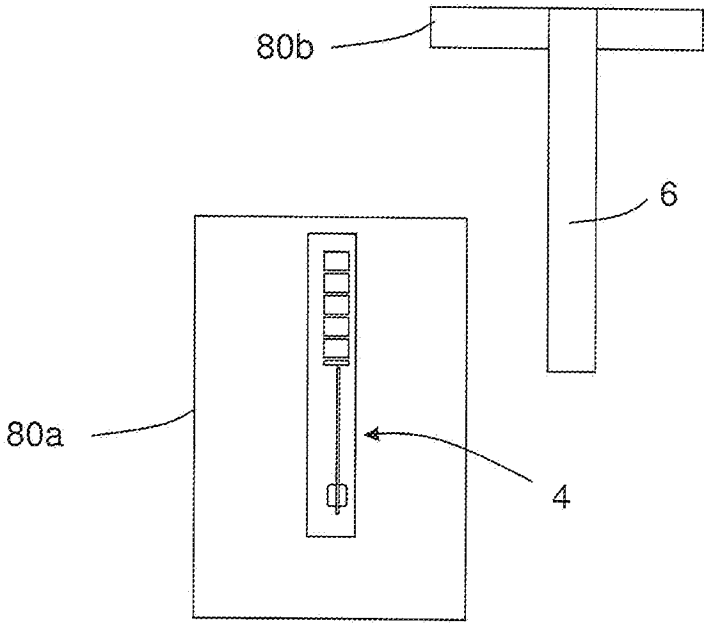
FIG. 4(*a*) is a schematic illustration of the microfluidic elapsed time indicator of FIG. 1 attached to a two-part container before opening of the container for the first time so as to activate the elapsed time indicator.
Figure 4:
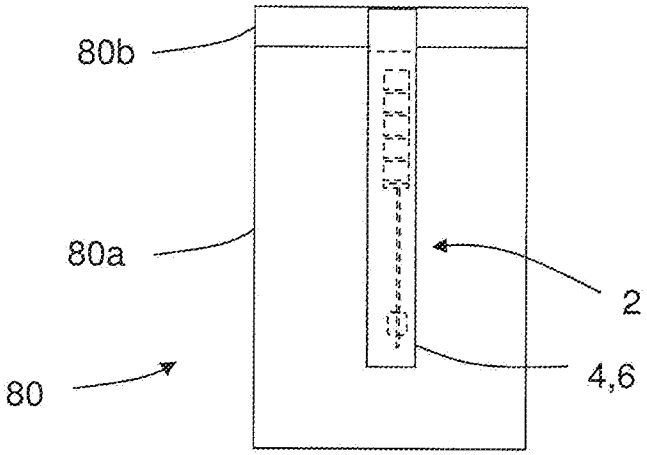

FIGS. 4(*a*) and 4(*b*) illustrate the use of the microfluidic elapsed time indicator 2 for use in monitoring the time elapsed from opening a container 80 for the first time. As shown in FIGS. 4(*a*) and 4(*b*), the container 80 includes two parts, namely a container body 80*a* and a container lid 80*b*. The lower surface 12 of the body 4 includes an adhesive layer for attachment of the lower surface 12 of the body 4 to the container body 80*a*. Similarly, the tab 6*a* of the seal member 6 includes an adhesive layer on a lower surface of the tab 6*a* for attachment of the lower surface of the tab 6*a* to the container lid 80*b*. The microfluidic elapsed time indicator 2 may be configured as, or may form part of, a label for attachment to the container 80. On opening the container 80 for the first time and separating the container lid 80*b* from the container body 80*a* for the first time the seal member 6 remains attached to the container lid 80*b* but is detached from the body 4 which remains attached to the container body 80*a* as shown in FIG. 4(*b*) unsealing the reservoir and indicator vents 24, 62 and thereby activating the microfluidic elapsed time indicator 2 as previously described above. As such, the microfluidic elapsed time indicator 2 may provide a progressive indication of the time elapsed from opening the container 80 for the first time and/or a progressive indication of the time remaining until expiry of the contents of the container 80.

Alternatively, the container body 80*a* and the container lid 80*b* may be unitary but may still be movable relative to one another so as to detach the seal member 6 from the body 4 on opening the container 80 for the first time. For example, the container body 80*a* and the container lid 80*b* may be unitary but may be pivotable relative to one another so as to detach the seal member 6 from the body 4 on opening the container 80 for the first time.

Alternatively, the body 4 could be attached to the container lid 80*b* and the tab 6*a* could be attached to the container body 80*a*.

Figure 5:
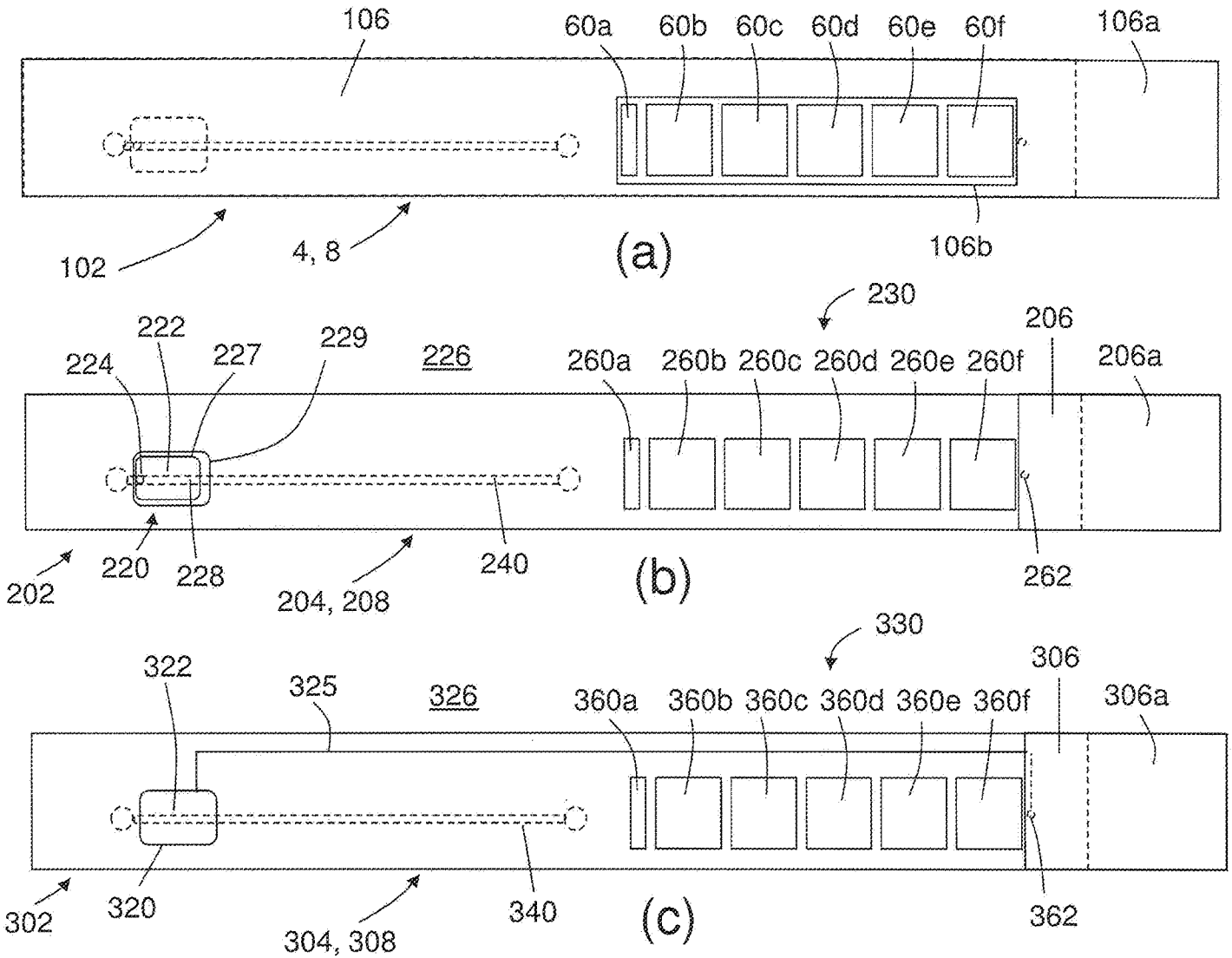
FIG. 5(*a*) is a schematic plan view of a first alternative microfluidic elapsed time indicator before activation.

Referring to FIG. 5(*a*), there is shown an alternative microfluidic elapsed time indicator generally designated 102 comprising the body 4 and a modified seal member 106 which is detachably attached to the upper surface 8 of the body 4. The microfluidic elapsed time indicator 102 of FIG. 5(*a*) is identical to the microfluidic elapsed time indicator 2 of FIG. 1 in all respects except for the modified seal member 106. Like the seal member 6, the modified seal member 106 defines a tab portion 106*a* which is distal from the body 4. However, unlike the seal member 6, the modified seal member 106 defines a transparent window or a window recess 106*b* such that the windows 60*a*, 60*b*, 60*c*, 60*d*, 60*e*, 60*f* of the upper cover layer 60 of the body 4 are clearly visible before the seal member 6 is detached from the body 4. The operation of the microfluidic elapsed time indicator 102 is identical to the operation of the microfluidic elapsed time indicator 2.

Referring to FIG. 5(*b*), there is shown a further microfluidic elapsed time indicator generally designated 202 comprising a body 204 and a seal member 206 which is detachably attached to an upper surface 208 of the body 204. The further microfluidic elapsed time indicator 202 of FIG.

5(*b*) is generally similar to the microfluidic elapsed time indicator 2 of FIG. 1 in many respects. However, unlike the body 4, the body 204 does not define the fluid reservoir. Instead, the body 204 defines a reservoir chamber 229 which contains a deformable reservoir membrane 227 which contains the fluid 222. The deformable reservoir membrane 227 defines a reservoir outlet fluid port 228. The reservoir chamber 229 defines a reservoir vent 224 which is permanently open to an external environment 226.

Like the body 4, the body 204 defines a display arrangement 230 including windows 260*a*, 260*b*, 260*c*, 260*d*, 260*e* and 260*f*. Like the body 4, the body 204 defines a microfluidic channel 240 which provides a fluid flow path between the reservoir 220 and the display arrangement 230. Like the body 4, the body 204 defines an indicator vent 262 which selectively provides a path for air flow to the external environment 226. Like the seal member 6, the seal member 206 defines a tab portion 206*a* which is distal from the body 204. However, unlike the seal member 6, the seal member 206 only seals the indicator vent 262 and does not seal the reservoir vent 224. The fluid 222 is retained in the reservoir 220 until the tab portion 206*a* of the seal member 206 is pulled and the indicator vent 262 is unsealed whereupon capillary action causes the fluid 222 to travel along the microfluidic channel 240 to the display arrangement 230 in a manner which is generally similar to that already described above in relation to the microfluidic elapsed time indicator 2. An indication of elapsed time from activation is then provided via the windows 260*a*, 260*b*, 260*c*, 260*d*, 260*e* and 260*f* in a similar manner to that described above in relation to the microfluidic elapsed time indicator 2.

Referring to FIG. 5(*c*), there is shown a yet further microfluidic elapsed time indicator generally designated 302 comprising a body 304 and a seal member 306 which is detachably attached to an upper surface 308 of the body 304. The microfluidic elapsed time indicator 302 of FIG. 5(*c*) is generally similar to the microfluidic elapsed time indicator 2 of FIG. 1 in many respects. Like the body 4, the body 304 defines a reservoir 320 of fluid 322 and a display arrangement 330 including windows 360*a*, 360*b*, 360*c*, 360*d*, 360*e* and 360*f*. Like the body 4, the body 304 defines a microfluidic channel 340 which provides a fluid flow path between the reservoir 320 and the display arrangement 330. Like the body 4, the body 304 defines an indicator vent 362 which selectively provides a path for air flow to the external environment 326. However, unlike the body 4, the body 304 defines an air flow path or channel 325 which extends internally of the body 4 from the reservoir 320 to an indicator vent 362. Like the seal member 6, the seal member 306 defines a tab portion 306*a* which is distal from the body 304. The seal member 306 seals the indicator vent 362. The fluid 322 is retained in the reservoir 320 until the tab portion 306*a* of the seal member 306 is pulled and the indicator vent 362 is unsealed whereupon capillary action causes the fluid 322 to travel along the microfluidic channel 340 to the display arrangement 330 in a manner which is generally similar to that already described above in relation to the microfluidic elapsed time indicator 2. The air flow path or channel 325 provides a path for air to flow from the external environment 326 to the reservoir 320 to replace fluid 322 lost from the reservoir 320. An indication of elapsed time from activation is then provided via windows 360*a*, 360*b*, 360*c*, 360*d*, 360*e* and 360*f* in a similar manner to that described above in relation to the microfluidic elapsed time indicator 2.

Figure 6:
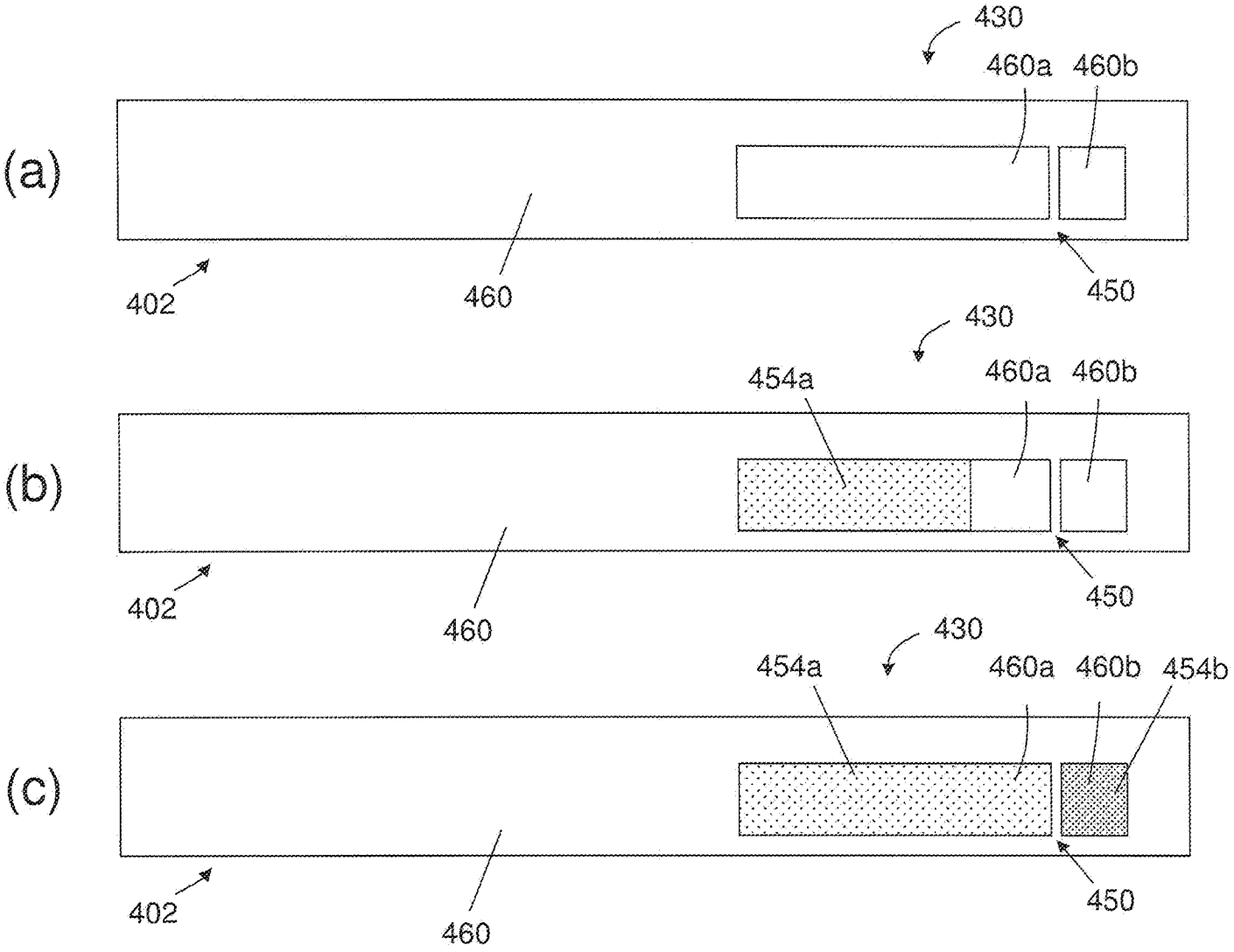
FIG. 6(*a*) is a schematic plan view of a fourth alternative microfluidic elapsed time indicator immediately after activation.

FIGS. 6(*a*) to 6(*c*) illustrate the operation of an alternative microfluidic elapsed time indicator 402 having an alternative display arrangement 430 which includes a first larger transparent window area 460*a* and a second smaller transparent window area 460*b* defined in an upper cover layer 460. The microfluidic elapsed time indicator 402 further includes a first larger green indicator area 454*a* which is generally aligned with the larger transparent window area 460*a* and a second smaller red indicator area 454*b* which is generally aligned with the smaller transparent window area 460*b*. The microfluidic elapsed time indicator 402 includes a porous sheet element in the form of a paper element 450 located between the cover layer 460 and the indicator areas 454*a*, 454*b*. Immediately after activation as shown in FIG. 6(*a*), neither of the indicator areas 454*a*, 454*b* is visible. As time elapses following activation, a fluid progressively impregnates the paper element 450 so as to progressively reveal the first indicator area 454*a* as shown in FIG. 6(*b*). After expiry of a first predetermined time period following activation, the fluid impregnates the paper element 450 so as to reveal the whole of first indicator area 454*a*. After expiry of a second and final predetermined time period following activation, the fluid impregnates the paper element 450 so as to also reveal the second indicator area 454*b* as shown in FIG. 6(*c*).

Figure 7:
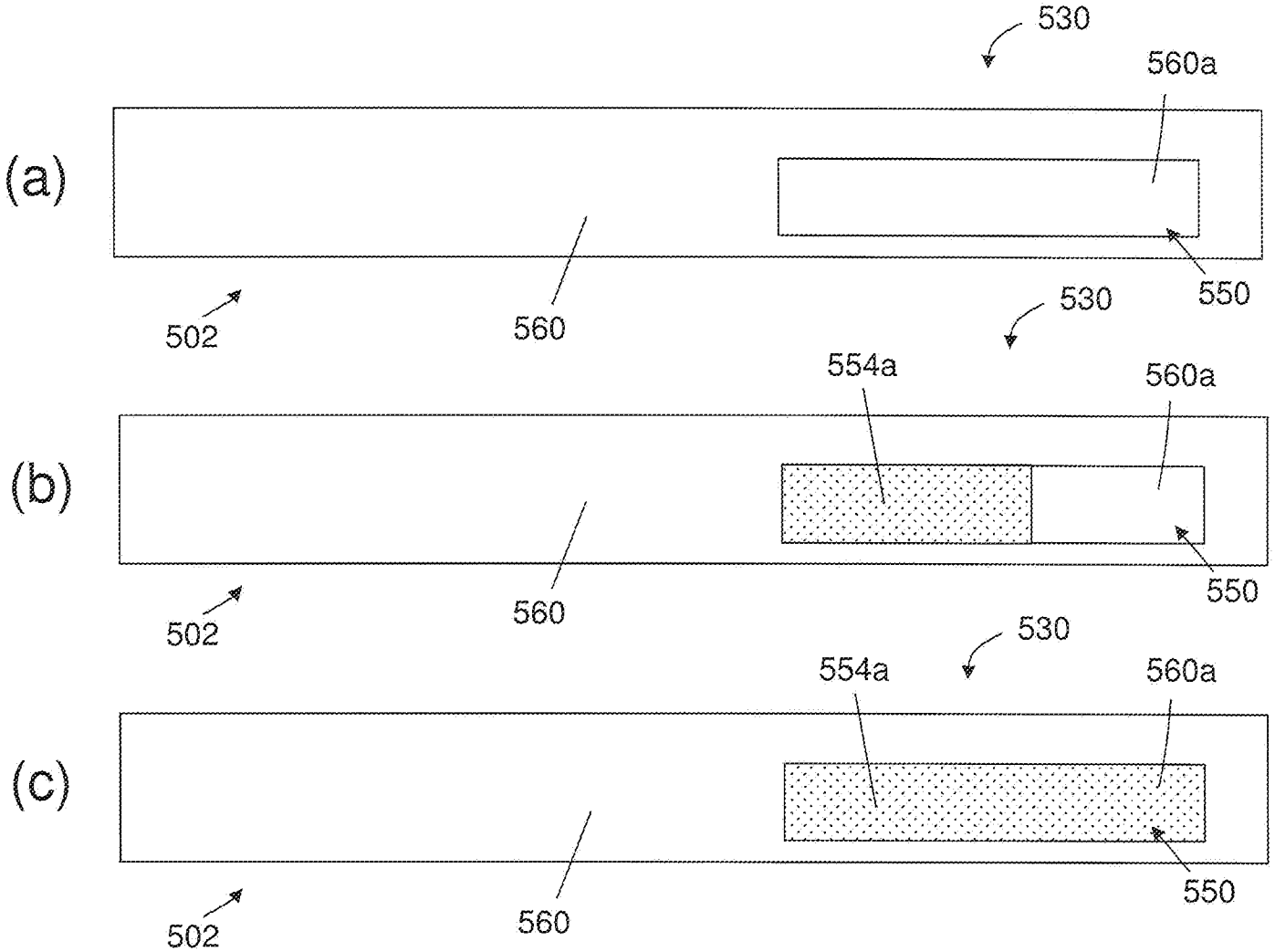
FIG. 7(*a*) is a schematic plan view of a fifth alternative microfluidic elapsed time indicator immediately after activation.

FIGS. 7(*a*) to 7(*c*) illustrate the operation of a further alternative microfluidic elapsed time indicator 502 having an alternative display arrangement 530 which includes a single elongate transparent window area 560*a* defined in an upper cover layer 560. The microfluidic elapsed time indicator 502 further includes a single elongate green indicator area 554*a* which is generally aligned with the transparent window area 560*a*. The microfluidic elapsed time indicator 502 includes a porous sheet element in the form of a paper element 550 located between the cover layer 560 and the indicator area 554*a*. Immediately after activation as shown in FIG. 7(*a*), the indicator area 554*a* is not visible or is not clearly visible. As time elapses following activation, a fluid progressively impregnates the paper element 550 so as to progressively reveal the indicator area 554*a* as shown in FIG. 7(*b*). After expiry of a predetermined time period following activation, the fluid impregnates the paper element 550 so as to reveal the whole of the indicator area 554*a* as shown in FIG. 7(*c*).

Figure 8:
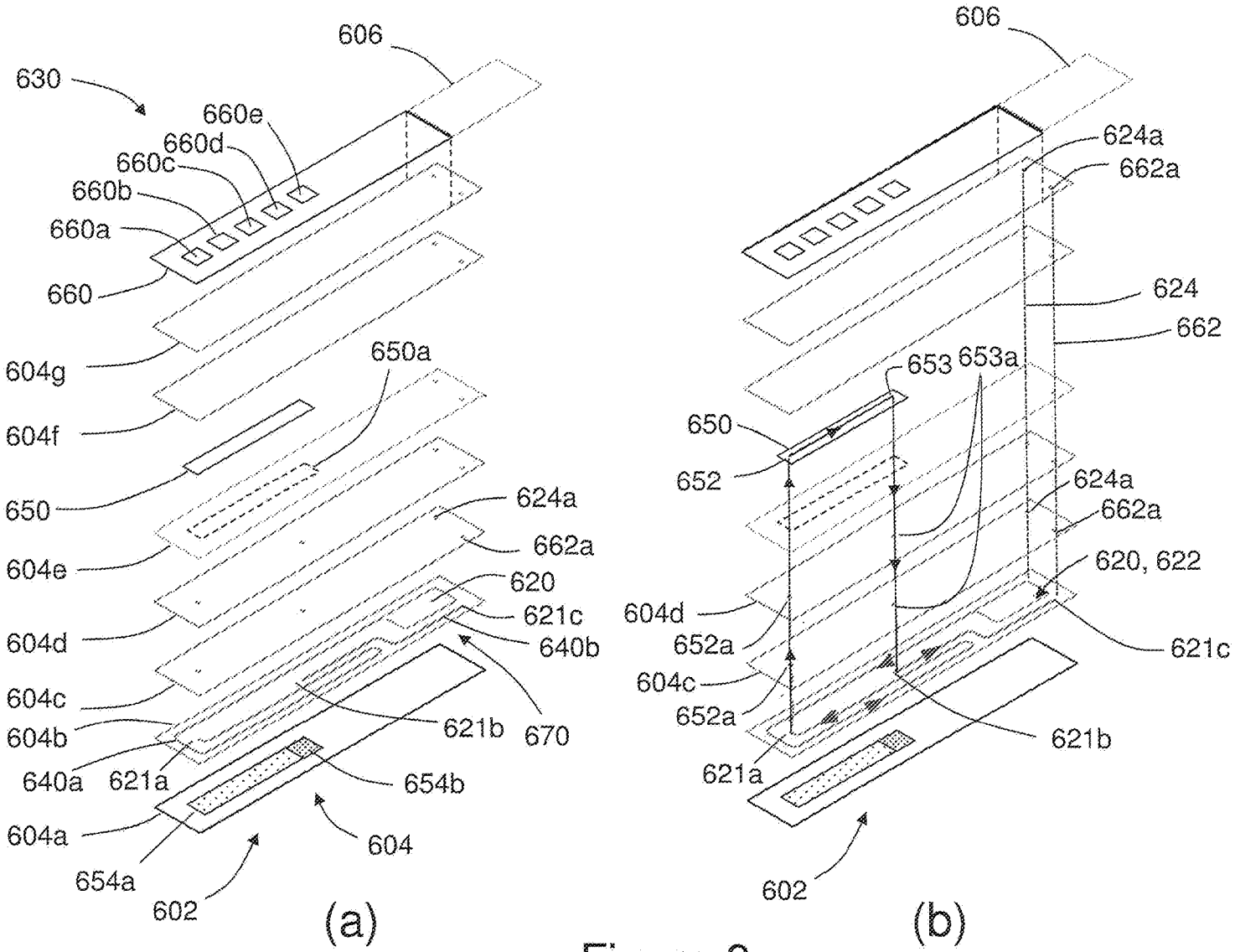
FIG. 8(*a*) is an exploded assembly view of a sixth alternative microfluidic elapsed time indicator.

A further alternative microfluidic elapsed time indicator 602 is shown in FIG. 8(*a*) which includes a base layer or substrate 604*a*, first and second coloured indicator areas 654*a* and 654*b* respectively defined on the substrate 604*a*, an upper cover layer 660 defining a plurality of transparent windows 660*a*, 660*b*, 660*c*, 660*d* and 660*e*, and a porous sheet element 650 located between the coloured indicator areas 654*a*, 654*b* and the cover layer 660. The first coloured indicator area 654*a* is green and the second coloured indicator area 654*b* is red. The transparent windows 660*a*, 660*b*, 660*c*, 660*d* are aligned above the first coloured indicator area 654*a* and the transparent window 660*e* is aligned above the second coloured indicator area 654*b*. The transparent windows 660*a* to 660*e*, the coloured indicator areas 654*a*, 654*b* and the porous sheet element 650 collectively define a display arrangement 630. The elapsed time indicator 602 includes an intermediate polyethylene terephthalate (PET) layer 604*e* defining an aperture 650*a* which accommodates the porous sheet element 650.

Located between the porous sheet element 650 and the coloured indicator areas 654*a* and 654*b* is a PET fluid management layer 604*b* which defines a fluid reservoir 620, an input microfluidic channel 640*a* extending from the fluid reservoir 620 to an outlet 621*a* adjacent to the first coloured indicator area 654*a* and an output microfluidic channel 640*b* extending from an inlet 621*b* adjacent to the second coloured indicator area 654*b* to an outlet 621*c* adjacent to the fluid reservoir 620.

The elapsed time indicator 602 includes one or more intermediate transparent layers 604*c*, and 604*d* between the fluid management layer 604*b* and the porous sheet element 650. Each of the intermediate transparent layers 604*c* and 604*d* may include transparent adhesive and/or transparent PET. Similarly, the elapsed time indicator 602 includes one or more further intermediate transparent layers 604*f* and 604*g* between the porous sheet element 650 and the cover layer 660. Each of the further intermediate transparent layers 604*f* and 604*g* may include transparent adhesive and/or transparent PET. The substrate 604*a*, the fluid management layer 604*b*, the intermediate layers 604*c*-604*g* and the cover layer 660 collectively define a body 604 of the elapsed time indicator 602. Unless otherwise stated below, one of ordinary skill in the art will understand that the various different layers 604*a*-604*g* are impervious, non-porous and/or impermeable to the fluid 622.

As shown in FIG. 8(*b*), each of the intermediate transparent layers 604*c* and 604*d* defines a corresponding aperture 652*a* to permit fluid to flow from the outlet 621*a* of the input microfluidic channel 640*a* to the porous sheet element 650. The apertures 652*a* collectively define an inlet fluid port 652 at or near one end of the porous sheet element 650. Similarly, each of the intermediate transparent layers 604*c* and 604*d* defines a corresponding aperture 653*a* to permit fluid to flow from the porous sheet element 650 to the inlet 621*b* of the output microfluidic channel 640*b*. The apertures 653*a* collectively define an outlet fluid port 653 at or near the other end of the porous sheet element 650.

Each of the intermediate layers 604*c*, 604*d*, 604*e*, 604*f*, 604*g* between the fluid management layer 604*b* and the cover layer 660 defines a corresponding aperture 624*a*. The apertures 624*a* collectively define a reservoir vent 624 which extends from the fluid reservoir 620 to the cover layer 660. Similarly, each of the intermediate layers 604*c*, 604*d*, 604*e*, 604*f*, 604*g* between the fluid management layer 604*b* and the cover layer 660 defines a corresponding aperture 662*a*. The apertures 662*a* collectively define an indicator vent 662 which extends from the outlet 621*c* of the output microfluidic channel 640*b* to the cover layer 660.

It should be understood that the reservoir vent 624, the fluid reservoir 620, the input microfluidic channel 640*a*, the inlet fluid port 652, the aperture 650*a* defined by the intermediate layer 604*e*, the intermediate layer 604*f*, the outlet fluid port 653, the output microfluidic channel 640*b* and the indicator vent 662 collectively define a cavity 670.

The reservoir 620 is filled with a fluid in the form of silicon oil 622.

The elapsed time indicator 602 further includes a seal member 606 which is initially attached to the cover member 660 so as to seal the reservoir vent 624 and the indicator vent 662 and, therefore, also the cavity 670, from an environment external to the elapsed time indicator 602.

During manufacture of the elapsed time indicator 602 before the seal member 606 is attached to the cover member 660, the silicon oil 622 is injected into the reservoir 620 through the reservoir vent 624. The seal member 606 is then attached to the cover member 660 so as to seal the reservoir vent 624 and the indicator vent 662 and, therefore, also the cavity 670. After sealing of the cavity 670, the silicon oil 622 initially moves along the input microfluidic channel 640*b* under capillary action causing a reduction in pressure of the air in the cavity 670 between the reservoir vent 624 and silicon oil 622 and an increase in pressure of the air in the cavity 670 between the silicon oil 622 and the indicator vent 662 until the forces acting on the silicon oil 622 due to capillary action are balanced by the forces acting on the silicon oil 622 due to the differential in the air pressures in the cavity 670 on opposite sides of the silicon oil 622. One of ordinary skill in the art will understand that this balance of forces may also be affected by the action of gravity/hydrostatic pressure acting on the silicon oil 622 according to the orientation of the elapsed time indicator 602.

The cavity 670 and the silicon oil 622 are configured such that the balance between the forces acting on the silicon oil 622 prevents the silicon oil 622 from reaching the porous sheet element 650 prior to the activation event, regardless of the orientation of the elapsed time indicator 602. For example, the cavity 670 and the silicon oil 622 may be configured such that the balance between the forces acting on the silicon oil 622 substantially contains the silicon oil 622 within the fluid reservoir 620 prior to the activation event with little or none of the silicon oil 622 being contained within the input microfluidic channel 640*b*, regardless of the orientation of the elapsed time indicator 602.

Figure 9:
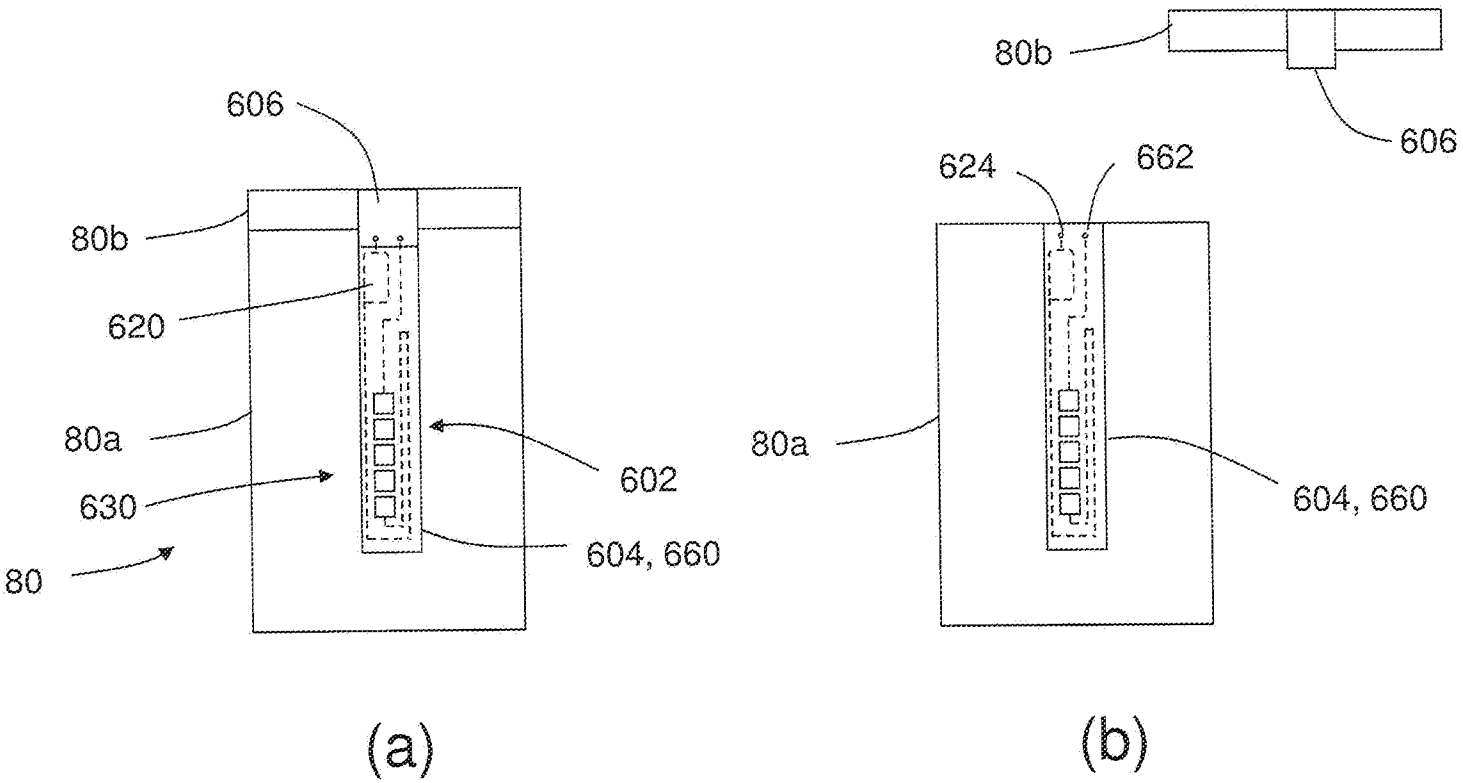
FIG. 9(*a*) is a schematic illustration of the sixth alternative microfluidic elapsed time indicator of FIGS. 8(*a*) and 8(*b*) attached to a two-part container before opening of the container for the first time so as to activate the elapsed time indicator.

In use, as shown in FIG. 9(*a*), the body 604 of the elapsed time indicator 602 is initially attached to a body 80*a* of a container 80 and the seal member 606 is attached to a lid 80*b* of the container 80*b*. The initial orientation of the elapsed time indicator 602 is such that the reservoir 620 is located generally vertically above the display arrangement 630 which includes the porous sheet element 650. The cover layer 660 may have markings such as "this way up" arrows or the like so as to indicate a required orientation of the elapsed time indicator 602. On removing the lid 80*b* of the container 80 from the body 80*a* of the container 80 for the first time, the seal member 606 becomes detached from the body 604 thereby exposing the reservoir vent 624 and the indicator vent 662 to the atmosphere external to the elapsed time indicator 602 as shown in FIG. 9(*b*). On exposure of the reservoir vent 624 and the indicator vent 662 to the atmosphere, movement of the silicon oil 622 along the input microfluidic channel 640*b* is no longer opposed by the pressure differential on opposite sides of the silicon oil 622 and the silicon oil 622 is free to move by virtue of capillary action possibly in combination with gravity/hydrostatic pressure from the reservoir 620 through the input microfluidic channel 640*a* and the inlet fluid port 652 to the porous sheet element 650 as indicated by the arrow heads in FIG. 8(*b*). The silicon oil 622 moves laterally along the porous sheet element 650 at a predetermined rate thereby rendering the porous sheet element 650 progressively transparent at a predetermined rate which depends on the nature of the porous sheet element 650 and properties such as the viscosity of the silicon oil 622. As the porous sheet element 650 becomes progressively transparent in the lateral direction, the first colour indicator area 654*a* is progressively revealed and may be viewed through the transparent windows 660*a* to 660*d* until all of the first colour indicator area 654*a* is revealed and the silicon oil 622 reaches the second colour indicator area 654*b*. Thereafter, the silicon oil 622 continues to move laterally along the porous sheet element 650 so as to progressively reveal the second colour indicator area 654*b* which may be viewed through the transparent window 660*e*. The rate of movement of the silicon oil 622 laterally along the porous sheet element 650 and the length of the porous sheet element 650 along the direction of travel of the silicon oil 622 may be selected so that the progressive appearance of the first and second coloured indicator areas 654*a* and 654*b* in the transparent window 660*a*-660*e* provides a progressive indication of the time remaining until expiry of a lifetime of the contents of the container 80.

One of ordinary skill in the art will understand that various modifications of the microfluidic elapsed time indicator 2 are possible. For example, different arrangements of the reservoir 20 and the display arrangement 30 and/or different arrangements of the indicator vent and the reservoir vent are possible according to the field of use. The or each microfluidic channel may follow any suitable path to permit fluid to move from the reservoir 20 to the porous sheet element 50 and, optionally, away from the porous sheet element 50. For example, the or each microfluidic channel may be curved or even define a 180° bend when viewed in plan.

One or more symbols, characters, letters, numbers or graphical representations may be printed or otherwise defined on the upper surface 8 of the upper cover layer 60. In particular, one or more symbols, characters, letters, numbers or graphical representations may be printed or otherwise defined adjacent to each of the windows 60*a*, 60*b*, 60*c*, 60*d*, 60*e*, 60*f* to provide an indication of the elapsed time associated with the appearance of the corresponding indicator area 54*a*, 54*b*, 54*c*, 54*d*, 54*e*, 54*f* in the relevant window 60*a*, 60*b*, 60*c*, 60*d*, 60*e*, 60*f*.

The invention claimed is:

1. An elapsed time indicator, comprising:

a reservoir of a fluid;

a porous sheet element; and a fluid port located between the reservoir and the porous sheet element, wherein the porous sheet element defines a predetermined area which is separated from the fluid port by a predetermined lateral distance, wherein the fluid is selectively provided from the reservoir to the porous sheet element through the fluid port whereupon the porous sheet element transmits the fluid laterally through the porous sheet element at a predetermined rate away from the fluid port until the fluid impregnates the predetermined area of the porous sheet element so as to cause the predetermined area of the porous sheet element to become transparent or more transparent after expiry of a predetermined time period.

2. The elapsed time indicator according to claim 1, wherein at least one of:

the fluid is colourless or clear;

the fluid comprises an oil or a mixture of oils; and the fluid comprises silicon oil.

3. The elapsed time indicator according to claim 1, wherein the porous sheet element is opaque or substantially opaque before impregnation by the fluid.

4. The elapsed time indicator according to claim 1, comprising an indicator element which becomes visible or more visible through the porous sheet element when the porous sheet element becomes transparent or more transparent, wherein the indicator element is coloured and/or the indicator element is green or red.

5. The elapsed time indicator according to claim 4, wherein the indicator element is non-porous and/or the indicator element is impervious to the fluid.

6. The elapsed time indicator according to claim 4, wherein the indicator element becomes visible or more visible through the predetermined area of the porous sheet element when the predetermined area of the porous sheet element becomes transparent or more transparent.

7. The elapsed time indicator according to claim 1, comprising:

a microfluidic channel which provides a fluid flow path from the reservoir to the fluid port.

8. The elapsed time indicator according to claim 1, wherein the fluid port comprises an inlet fluid port and the elapsed time indicator comprises:

an input microfluidic channel extending from the reservoir to the inlet fluid port;

an outlet fluid port for receiving fluid from the porous sheet element; and an output microfluidic channel which provides a fluid flow path from the outlet fluid port.

9. The elapsed time indicator according to claim 8, wherein the inlet fluid port is defined at, adjacent or near one end of the porous sheet element and the outlet fluid port is defined at, adjacent or near the other end of the porous sheet element.

10. The elapsed time indicator according to claim 7, wherein the reservoir and/or the or each microfluidic channel is configured to control the rate of transfer of the fluid from the reservoir to the fluid port.

11. The elapsed time indicator according to claim 7, wherein the reservoir and/or the or each microfluidic channel is configured to allow the fluid to be transferred from the reservoir to the fluid port in a predetermined transfer time period which constitutes a small or negligible proportion of the predetermined time period, wherein the predetermined transfer time period constitutes less than one tenth of the predetermined time period, less than 1/20 of the predetermined time period, less than 1/50 of the predetermined time period, less than 1/100 of the predetermined time period, less than 1/1000 of the predetermined time period or less than 1/10000 of the predetermined time period.

12. The elapsed time indicator according to claim 7, wherein the reservoir and/or the or each microfluidic channel is configured to control the predetermined rate at which the fluid is transmitted laterally through the porous sheet element.

13. The elapsed time indicator according to claim 7, comprising a body which defines a cavity, which cavity defines and/or contains the reservoir of the fluid, each microfluidic channel, the fluid port and the porous sheet element.

14. The elapsed time indicator according to claim 13, wherein the body defines a reservoir vent extending from the cavity from a position at or adjacent to the reservoir and/or an indicator vent extending from the cavity from a position at or adjacent to the porous sheet element.

15. The elapsed time indicator according to claim 14, wherein the reservoir vent extends from the cavity from a position at, adjacent or near to one end of the cavity and the indicator vent extends from the cavity from a position at, adjacent or near to the other end of the cavity.

16. The elapsed time indicator according to claim 14, comprising a seal member detachably attached to the body so as to initially seal at least one of the reservoir vent and the indicator vent.

17. The elapsed time indicator according to claim 16, wherein at least one of the reservoir vent and the indicator vent is unsealed by detaching the seal member from the body to thereby permit the fluid to flow from the reservoir towards the fluid port.

18. The elapsed time indicator according to claim 14, comprising a seal member which is detachably attached to the body so as to initially seal one of the reservoir vent and the indicator vent, and wherein the reservoir vent and the indicator vent are connected by a channel for air which is defined separately from the microfluidic channel such that detaching the seal member from the body unseals both the reservoir vent and the indicator vent to thereby permit the fluid to flow from the reservoir towards the fluid port.

19. The elapsed time indicator according to claim 18, wherein the channel for air is defined by the body.

20. The elapsed time indicator according to claim 14, wherein one of the reservoir vent and the indicator vent is permanently open and the other of the reservoir vent and the indicator vent is configured to be selectively unsealed to provide a flow path for air between the cavity and the environment external to the elapsed time indicator to thereby permit the fluid to flow from the reservoir towards the fluid port.

21. The elapsed time indicator according to claim 13, wherein air in the cavity on a first side of the fluid in the fluid reservoir is at a first pressure prior to an activation event and wherein air in the cavity on a second side of the fluid in the fluid reservoir opposite the first side is at a second pressure prior to the activation event, wherein the first pressure is less than the second pressure.

22. The elapsed time indicator according to claim 1, wherein the porous sheet element comprises a plurality of predetermined areas, each predetermined area being separated from the fluid port by a corresponding predetermined lateral distance such that one of the predetermined areas of the porous sheet element becomes transparent or more transparent after expiry of the predetermined time period and each of the other predetermined areas become transparent or more transparent after expiry of a corresponding intermediate predetermined time period.

23. The elapsed time indicator according to claim 22, wherein each of the intermediate predetermined time periods is a predetermined proportion of the predetermined time period.

24. The elapsed time indicator according to claim 1, wherein the predetermined rate of transmission of the fluid in the porous sheet element depends on at least one of:

at least one property of the fluid;

the composition and/or viscosity of the fluid;

at least one property of the porous sheet element; and the permeability and/or the porosity of the porous sheet element.

25. The elapsed time indicator according to claim 1, wherein the porous sheet element comprises at least one of fibres, cellulose fibres, paper and filter paper.

26. A method for indicating an elapsed time, comprising:

providing a porous sheet element;

providing a fluid port;

defining a predetermined area of the porous sheet element which is separated from the fluid port by a predetermined lateral distance; and selectively providing a fluid to the porous sheet element through the fluid port whereupon the porous sheet element transmits the fluid laterally through the porous sheet element at a predetermined rate away from the fluid port until the fluid impregnates the predetermined area of the porous sheet element so as to cause the predetermined area of the porous sheet element to become transparent or more transparent after expiry of a predetermined time period.

27. The elapsed time indicator according to claim 21, wherein the air in the cavity on the first side of the fluid in the fluid reservoir comprises air in the cavity above the fluid in the fluid reservoir, and wherein the air in the cavity on the second side of the fluid in the fluid reservoir comprises air in the cavity below the fluid in the fluid reservoir.

* * * * *